United States Patent [19]

Yamauchi et al.

[11] Patent Number: 4,563,993

[45] Date of Patent: Jan. 14, 1986

[54] FUEL FEEDING APPARATUS

[75] Inventors: Teruo Yamauchi; Yoshishige Oyama, both of Katsuta, Japan

[73] Assignee: Hitachi, Ltd., Tokyo, Japan

[21] Appl. No.: 585,195

[22] Filed: Mar. 1, 1984

[30] Foreign Application Priority Data

Mar. 7, 1983 [JP] Japan ..... 58-35970

[51] Int. Cl.[4] ..... F02B 3/00

[52] U.S. Cl. ..... 123/478; 123/472; 261/81; 261/DIG. 48

[58] Field of Search ..... 123/472, 494, 478, 490; 261/81, DIG. 48

[56] References Cited

U.S. PATENT DOCUMENTS

| | | | |
|---|---|---|---|
| 3,893,434 | 7/1975 | Thatcher | 123/478 |
| 4,105,004 | 8/1978 | Asai | 123/478 |
| 4,121,549 | 10/1978 | Martin | 123/494 |
| 4,167,158 | 9/1979 | Martin | 123/478 |
| 4,418,672 | 12/1983 | Muller | 123/478 |

*Primary Examiner*—Ronald B. Cox

*Attorney, Agent, or Firm*—Antonelli, Terry & Wands

[57] ABSTRACT

In a fuel feeding apparatus of the type in which a vibrating element is vibrated by an electro-mechanical transducer converting electrical oscillation into mechanical vibration, and fuel injected from a fuel feeding part is directed to impinge against and atomized by the vibrating element, the frequency of the electrical oscillation applied to the transducer is changed at a predetermined period to promote atomization of fuel.

11 Claims, 23 Drawing Figures

FUEL FEEDING APPARATUS

This invention relates to a fuel feeding apparatus for an internal combustion engine of a motor vehicle.

A carburetor and a fuel injection unit represent two types of practical fuel feeding apparatus for feeding fuel to an internal combustion engine.

In these fuel feeding apparatus, it is generally required to sufficiently atomize fuel fed to the internal combustion engine for the purposes of minimizing the quantity of harmful or toxic components contained in exhaust gases and decreasing the fuel consumption.

In, for example, Japanese Laid-Open Application 53-140416 (1978), a means for atomizing or reducing the particle size of fuel in the form of an ultrasonic vibrator with the excitation or resonance frequency of the ultrasonic vibrator being calculated in dependence upon the required degree of fuel atomization and the required electric power has been proposed.

However, a disadvantage of the above proposed construction resides in the fact that even when the ultrasonic vibrator is driven at the calculated excitation frequency, the weight of the ultrasonic vibrator itself will not be maintained constant but will vary in dependence upon whether or not fuel attaches to or accumulates on the ultrasonic vibrator, and, with an accumulation of fuel, the resonant point of the ultrasonic vibrator will be shifted by the amount corresponding to the variation of the weight of the ultrasonic vibrator.

A shift of the resonant point of the ultrasonic vibrator results in an impossibility of ensuring the required vibrator amplitude full atomization of fuel, and such a phenomenon gives rise to a formation of a liquid fuel film by the particles of fuel accumulating on the ultrasonic vibrator, and formation of droplets of fuel which fall from the peripheral edge of the lower end of the ultrasonic vibrator.

It is also known that the ultrasonic vibrator under vibration has a region of maximum amplitude and a region of minimum amplitude. Attaching of fuel to the minimum amplitude region of the ultrasonic vibrator gives rise to a phenomenon wherein the fuel is not sufficiently atomized but forms a liquid fuel film on the ultrasonic vibrator, and droplets of fuel drop from the peripheral edge of the lower end of the ultrasonic vibrator. This dropping of droplets of fuel is disadvantageous in that the concentration of harmful or toxic components contained in exhaust gases, especially, the concentration of carbon monoxide (CO) shows a sharp increase.

It is therefore a primary object of the present invention to provide a fuel feeding apparatus equipped with a fuel atomizing unit capable of atomizing fuel into uniform and fine particles.

In accordance with an advantageous feature of the present invention, the excitation frequency of the ultrasonic vibrator is periodically changed at a predetermined time interval.

Additionally, in accordance with the present invention fuel attaches to the ultrasonic vibrator on or in the vicinity of the maximum amplitude region of the ultrasonic vibrator under vibration.

The present invention will become apparent from the following detailed description taken in conjunction with the accompanying drawings, in which.

Figure 4A:
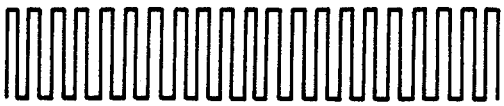
Figure 4B:
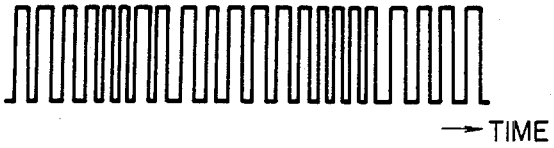
Figure 6:
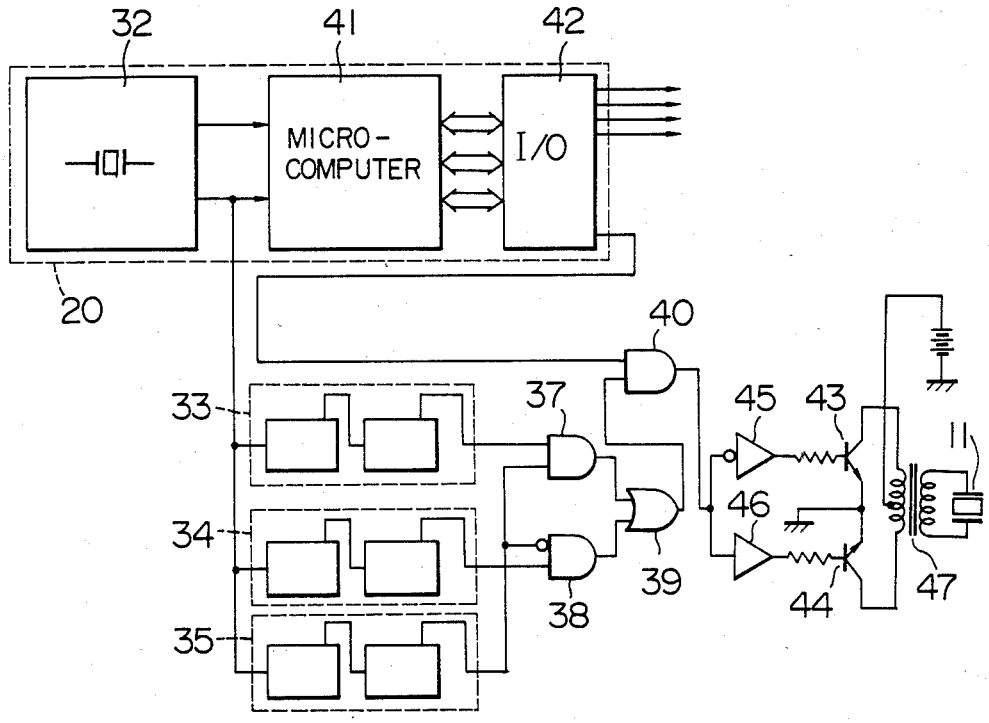
Figure 7:
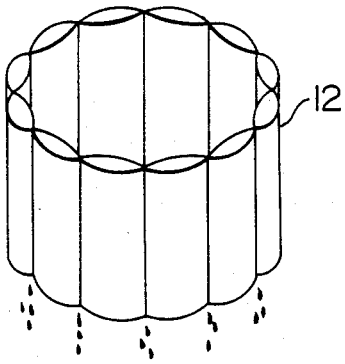
Figure 8:
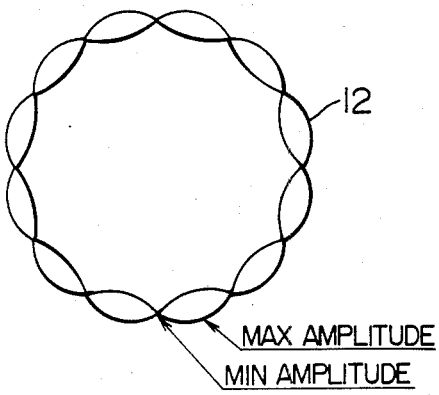
Figure 15:
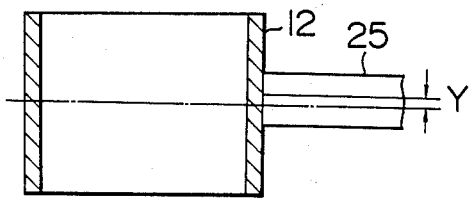
Figure 16:
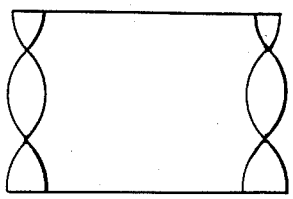
Figure 17:
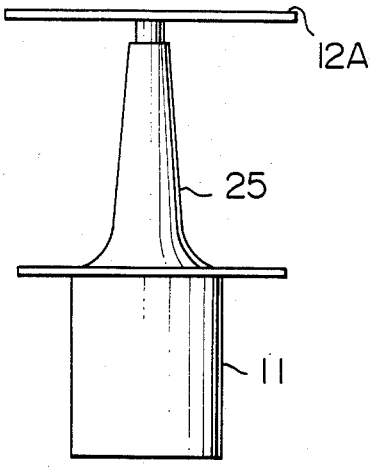
Figure 18:
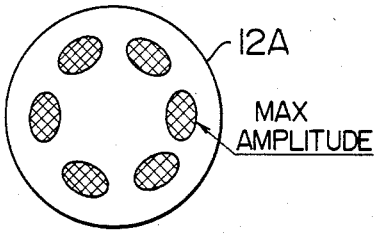

FIGS. 4(*a*), 4(*b*), 5(*a*), 5(*b*) and 5(*c*) are charts illustrating the modes of excitation of the ultrasonic vibrator;

FIG. 6 is a circuit diagram of a circuit provided for exciting the ultrasonic vibrator;

FIG. 7 is a perspective view of the ultrasonic vibrator to illustrate the vibrator under vibration;

FIG. 8 is a top plan view of FIG. 7;

FIGS. 9 to 14 illustrating various positional relationships between the fuel injection valve and the ultrasonic vibrator;

FIG. 15 is a cross-sectional view of the annular vibrating element of the ultrasonic vibrator;

FIG. 16 illustrates the axial vibration of the annular vibrating element;

FIG. 17 is a front elevation view of another form of the ultrasonic vibrator;

FIG. 18 is a top plan view of the ultrasonic vibrator of FIG. 17; and

Figure 19:
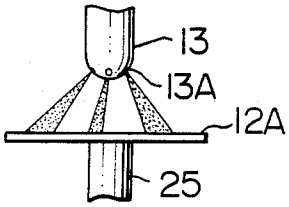
Figure 20:
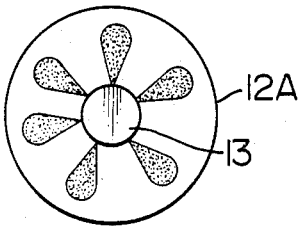

FIGS. 19 and 20 respectively illustrating the positional relationship between the fuel injection valve and the ultrasonic vibrator of FIG. 17.

Preferred embodiments of the present invention will now be described in detail with reference to the drawings.

Figure 1:
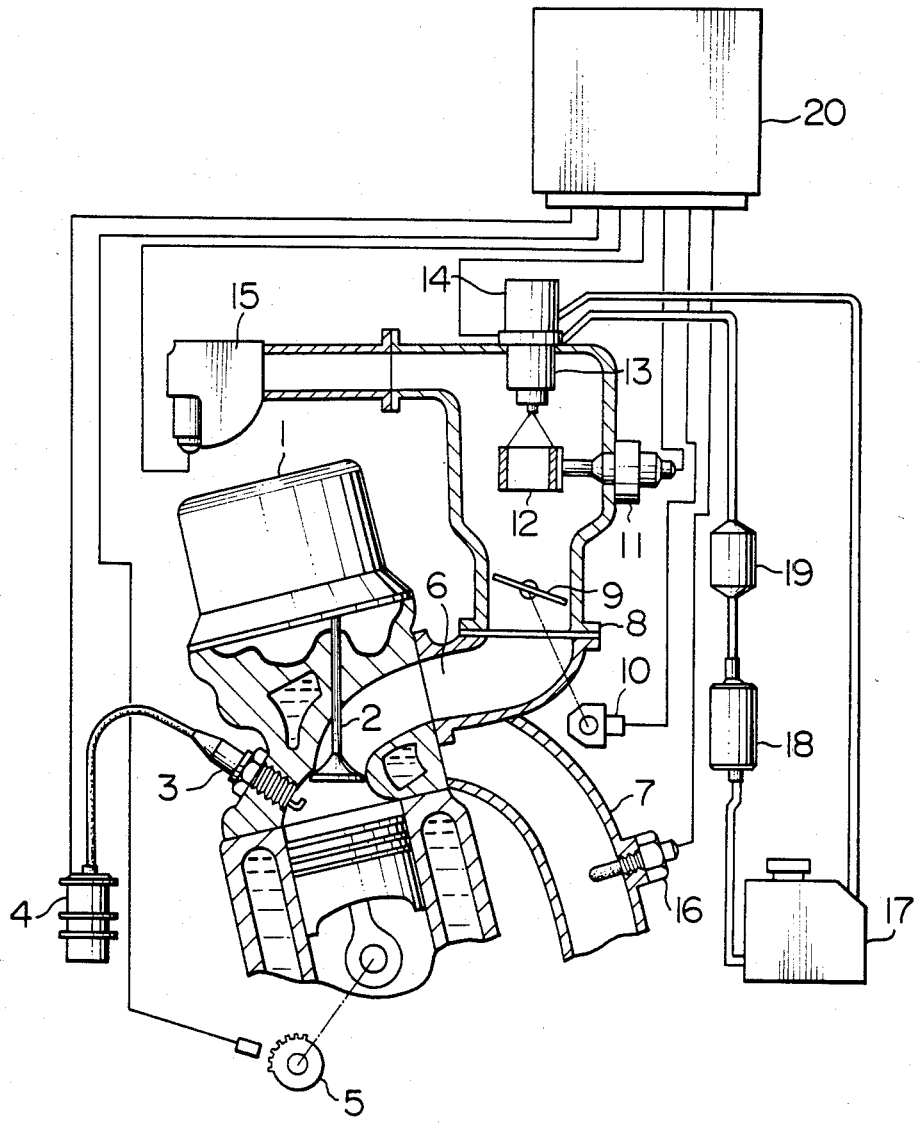
FIG. 1 is a partial cross-sectional diagrammatic view of an internal combustion engine to which the present invention is applied.

Referring now to the drawings wherein like reference numerals are used throughout the various views to designate like parts and, more particularly, to FIG. 1, according to this figure, an intake valve 2 of an internal combustion engine 1 of a motor vehicle is periodically opened to draw air and fuel through an intake pipe or manifold 6, and the fuel-air mixture is ignited by a spark plug 3 for combustion of the fuel-air mixture. The output of the engine 1 is transmitted to driving wheels (not shown) of the motor vehicle, with a crank angle sensor 5 sensing the crank angle of the engine 1 and applying an output signal to a microcomputer 20. The microcomputer 20 supplies a control output signal to an ignition coil 4 at required ignition timing so as to ignite the fuel-air mixture by the spark plug 3. A fuel-air mixing funnel 8 is connected as a part of the intake pipe 6, and a throttle valve 9 disposed therein controls the quantity of air. A throttle opening sensor 10 continuously senses the opening of the throttle valve 9 and supplies an output signal to the microcomputer 20 which processes and stores the throttle valve opening data. The mixing funnel 8 includes a slightly outwardly expanding portion upstream of the throttle valve 9, and an ultrasonic vibrator 11 is mounted and fixed from outside to the outwardly expanding portion of the mixing funnel 8. The ultrasonic vibrator 11 includes an annular vibrating element 12 having a central axis aligned with central axis of the mixing funnel 8. The mixing funnel 8 has an L-shaped configuration in an upper portion thereof, and an electromagnetic fuel injection valve 13 (which may be of the timed or intermittent injection type or the continuous injection type) is inserted and fixed from outside in portion of the mixing funnel 8. The central axis of the fuel injection valve 13 is also in alignment with the central axis of the mixing funnel 8.

A fuel pressure regulator 14 is coupled integrally to the fuel injection valve 13, and fuel pumped out from a fuel tank 17 by a fuel pump 18 is fed through a filter 19 to the regulator 14. The fuel pressure is regulated to a predetermined level by the regulator 14, and an excess of fuel is returned to the fuel tank 17 from the regulator 14.

An air quantity sensor 15 (which may be any one of the movable vane type, the hot wire type and the Karman vortex type) for metering the quantity of air is disposed upstream of the mixing funnel 8 and applies its output signal to the microcomputer 20. On the other hand, exhaust gases produced as a result of combustion and flowing through an exhaust pipe 7 are sensed by an oxygen sensor 16 and are finally discharged to the atmosphere after flowing, through a catalyst (not shown) and a silencer (not shown). The oxygen sensor 16 has an output signal level which varies in dependence upon the concentration of excess oxygen contained in the exhaust gases, and this is utilized to estimate the concentration of the fuel-air mixture drawn into the engine 1, thereby controlling the open duration of the fuel injection valve 13 to ensure the low fuel consumption and high exhaust purification performance.

Figure 2:
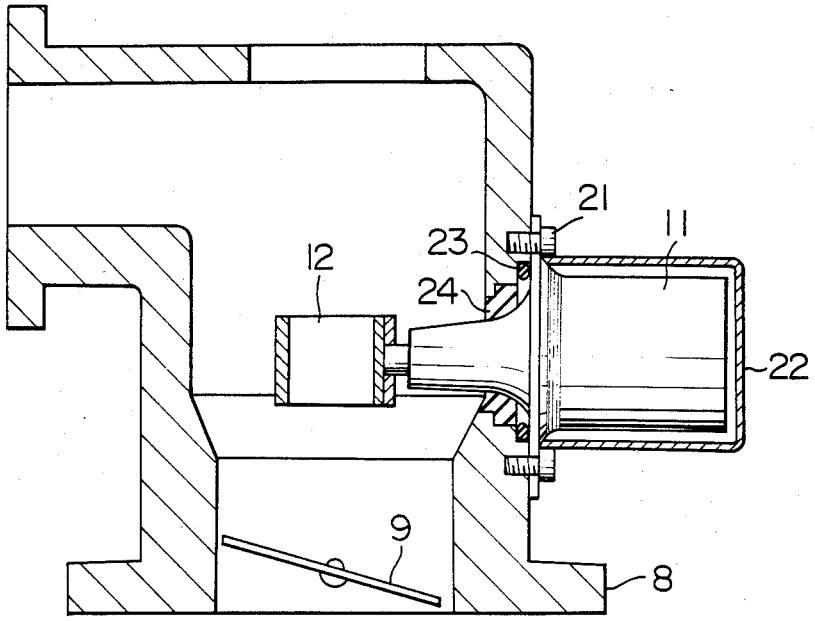
FIG. 2 is a cross-sectional view of fuel-air mixing funnel shown in FIG. 1.

Referring to FIG. 2, the ultrasonic vibrator 11 is partly inserted into an opening formed in a portion of the side wall of the mixing funnel 8 and is fixed thereto by machine screws 21 which also fix a vibrator cover 22 to the mixing funnel 8, with the cover 22 being preferably made of a metallic material to reduce noise which may be generated. Prior to mounting of the ultrasonic vibrator 11 in that position, an O-ring 23 and a rubber pad 24 are fitted in the opening of the mixing funnel 8, with the O-ring 23 preventing leakage of air, and the rubber pad 24 preventing intrusion of fuel.

Figure 3:
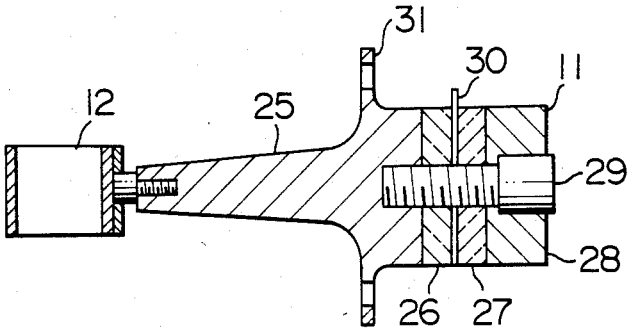
FIG. 3 is a cross-sectional view of the ultrasonic vibrator shown in FIG. 1.

Referring to FIG. 3, the ultrasonic vibrator 11 includes, besides the annular vibrating element 12, a horn portion 25, a pair of piezoelectric elements 26, 27, a retaining plate 28, a screw 29 holding the piezoelectric elements 26, 27 under pressure engagement between the horn portion 25 and the retaining plate 28, a voltage input terminal strip 30 interposed between the piezoelectric elements 26, 27, and a flange portion 31 integrally formed with the horn portion 25. When a pulse voltage of 300 V to 500 V is applied across the terminal strip 30 and the ground (which is, for example, the flange portion 31), the piezoelectric elements 26, 27 alternately expand and contract with a resultant vibration being transmitted to the annular vibrating element 12 connected to the free end of the horn portion 25.

When the ultrasonic vibrator 11 is excited at a predetermined frequency, a spray of fuel injected from the fuel injection valve 13 impinges against the annular vibrating element 12 and is instantaneously atomized to be drawn into the cylinder of the engine 1. From the microscopic aspect, the weight of the annular vibrating element 12 is subject to a variation at the moment of attachment of fuel to the annular vibrating element 12, and the resonant point of the annular vibrating element 13 shifts by an amount corresponding to the weight variation, with shift of the resonant point of the annular vibrating element 12 resulting in an impossibility of maintaining the amplitude of vibration required for full atomization of fuel. Consequently, atomization of fuel will be delayed to promote accumulation of a liquid fuel film on the annular vibrating element 12, and a vicious cycle of delayed atomization of fuel and promoted liquid fuel film accumulation will arise. Such an objectionable phenomenon can be fundamentally avoided when the vibration frequency of the ultrasonic vibrator 11, driving the annular vibrating element 12, is only slightly changed by the amount corresponding to the weight of the liquid fuel film accumulating in a very small quantity. By so changing the vibration frequency of the ultrasonic vibrator 11, fuel tending to form the accumulating film is instantaneously atomized, so that the possibility of formation of the liquid fuel film can be eliminated.

FIG. 4(*a*) provides an example of a fundamental waveform of the voltage applied normally to the ultrasonic vibrator 11. However, application of such a voltage waveform gives rise to the troubles described above. Therefore, when the waveform of the applied voltage is periodically changed at a time interval of, for example, between 0.1 ms and 10 ms as shown in FIG. 4(*b*), uniform and fine particles of fuel can be supplied in a fuel feeding system in which fuel is continuously fed.

Figure 5A:
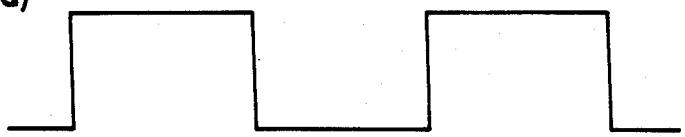
Figure 5B:
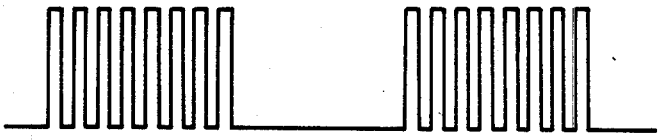
Figure 5C:
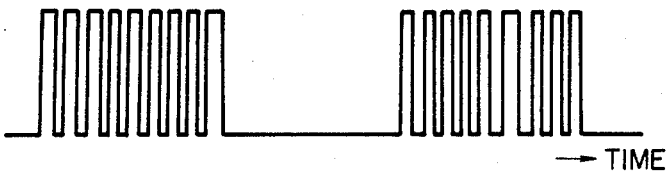

The same applies also to a fuel feeding system in which fuel is fed discontinuously or intermittently as shown in FIG. 5(*a*) which illustrates a waveform of a pulse voltage applied to the fuel injection valve 13 when the valve 13 is of the timed or intermittent injection type. As shown in FIG. 5(*a*), fuel is injected from the fuel injection valve 13 during the onduration of the pulse voltage. In the case of prior art ultrasonic vibration, the ultrasonic vibrator 11 is excited to atomize the spray of fuel during only the period of time in which the fuel injection valve 13 is kept opened, as shown in FIG. 5(*b*). However, the aforementioned vicious cycle of delayed fuel atomization and promoted liquid fuel film accumulation arises when the ultrasonic vibrator 11 is excited at a constant frequency. Also, in the case of the intermittent fuel injection, the quantity of fuel injected per unit time is always equivalent to the maximum flow rate, and, thus, the intermittent fuel injection is defective in that the tendency of liquid fuel film formation is high compared with the continuous fuel injection. Therefore, when the frequency of the voltage exciting the ultrasonic vibrator 11, during only the open-duration of the fuel injection valve 13, is similarly slightly changed as shown in FIG. 5(*c*), the possibility of liquid fuel film formation can be eliminated to ensure full atomization of fuel into uniform and fine particles.

FIG. 6 shows the structure of a driving circuit when the frequency of the voltage applied across the ultrasonic vibrator 11 is periodically changed in the continuous fuel feed mode.

More particularly, as shown in FIG. 6, a clock circuit 32 generates a clock signal at a predetermined constant frequency and includes a crystal oscillator oscillating at a frequency of, for example, 12 MHz, with the clock circuit 32 also acting as a source of clock pulses in the microcomputer 20 (FIG. 1). The clock signal generated from the clock circuit 32 is turned into signals having frequencies of, for example 21.5 kHz, 20.5 kHz and 2 kHz by three frequency divider circuits 33, 34, and 35, respectively, with the signals having the frequencies of 21.5 kHz and 20.5 kHz being employed to excite the ultrasonic vibrator 11, and the signal having the frequency of 2 kHz being used to switch over between the signals having the excitation frequencies of 21.5 kHz and 20.5 kHz. Therefore, in the continuous fuel feed mode in which the ultrasonic vibrator 11 is continuously excited, the excitation frequency is switched over at a time interval of, for example, 0.5 ms. The frequency divider circuit 33 dividing the clock frequency into the frequency of 21.5 kHz and the frequency divider circuit 34 dividing the clock frequency into the frequency of 20.5 kHz, independently generate the two types of signals having different frequencies as shown in FIG. 4(*b*), and the frequency divider circuit 35, dividing the clock frequency into the frequency of 2 kHz, generates the switching signal switching over between the two above-described signals. The combination of AND circuits 37, 38 and an OR circuit 39 provides a signal which is composed of the 21.5-kHz signal generated from the frequency divider circuit 33 and the 20.5-kHz signal generated from the frequency divider circuit 34. An engine-control I/O LSI 42 connected to a microcomputer 41 applies a control signal to an AND circuit 40 so as to control the above composite signal appearing at the output of the OR circuit 39. That is, such a control signal is applied to the AND circuit 40 whenever excitation of the ultrasonic vibrator 11 is required. A pair of power transistors 43, 44 amplify the on-off signal applied through two NOT circuits 45, 46 to periodically interrupt primary current supplied to the primary winding of a high-voltage generator coil 47. The secondary winding of the high-voltage generator coil 47 is connected across the ultrasonic vibrator 11 to apply the induced high AC voltage across the ultrasonic vibrator 11.

The control signal generated from the I/O LSI 42 is also used to control the operation of the ultrasonic vibrator 11 in the case of intermittent ignition as shown in FIG. 5(*c*). That is, the control signal applied from the I/O LSI 42 to the AND circuit 40 in such a case is synchronous with the period of energization of the fuel injection valve 13 so as to control the operation of the ultrasonic vibrator 11 in the intermittent ignition mode. The ultrasonic vibrator 11 may be continuously excited as shown in FIG. 4(*b*) even when fuel is supplied in an intermittent relationship. It can thus be seen that atomization of fuel can be further promoted by periodically changing the excitation frequency of the ultrasonic vibrator 11.

An even number of maximum amplitude regions and an even number of minimum amplitude regions are alternately formed on the annular vibrating element 12 of the ultrasonic vibrator 11 under vibration, as shown in FIGS. 7 and 8. The number of such regions differs depending on the factors including the outer diameter, wall thickness and material of the annular vibrating element 12 and the excitation frequency.

When fuel is injected in the form of a conical spray toward the inner surface of the upper end edge of such an annular vibrating element 12, fuel directed toward the minimum amplitude regions will hardly be atomized and will form a liquid fuel film resulting in dropping of fuel as droplets, although fuel directed toward the maximum amplitude regions is sufficiently atomized.

According to the present invention which solves the above problem, fuel is injected from the fuel injection valve 13 with a directivity so that fuel can be directed toward the maximum amplitude regions of the annular vibrating element 12.

Figure 9:
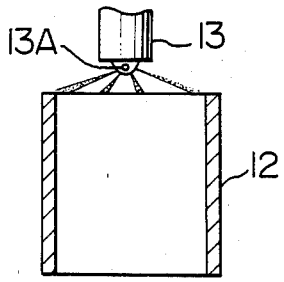
Figure 10:
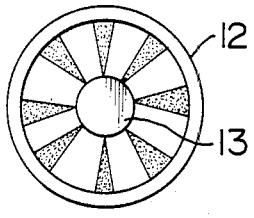
Figure 11:
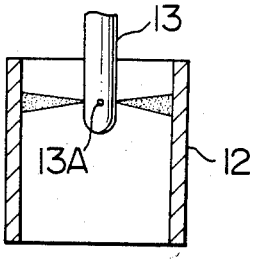
Figure 12:
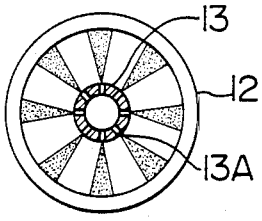
Figure 13:
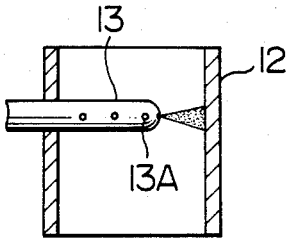
Figure 14:
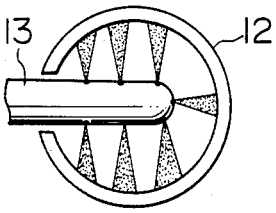

FIGS. 9 and 10 show that the injection nozzle of the fuel injection valve 13 has nozzle holes 13A disposed above the upper end of the annular vibrating element 12. FIGS. 11 and 12 show that the nozzle holes 13A of the injection nozzle of the fuel injection valve 13 are disposed inside the annular vibrating element 12. FIGS. 13 and 14 show that the nozzle holes 13A of the injection nozzle of the fuel injection valve 13 are disposed also inside the annular vibrating element 12. The arrangement shown in FIGS. 13 and 14 differs from that shown in FIGS. 11 and 12 in that the the central axis of the annular vibrating element 12 makes right angles with that of the fuel injection valve 13 in the former, whereas, the central axis of the annular vibrating element 12 aligns with that of the fuel injection valve 13 in the latter. In any one of the above arrangements, the nozzle holes 13A of the nozzle of the fuel injection valve 13 are so disposed as to direct fuel toward the maximum amplitude regions of the annular vibrating element 12 thereby promoting the atomization of fuel.

Further, the annular vibrating element 12 vibrates also in its axial direction in such a mode so as to produce maximum and minimum amplitude regions as shown in FIGS. 15 and 16. Therefore, the direction of fuel injected from the fuel injection valve 13 is preferably so selected that fuel impinges against the maximum amplitude regions of the annular vibrating element 12. In this case, in view of the fact that the maximum amplitude regions are successively formed in the upper and lower parts of the annular vibrating element 12 relative to the point of junction between the annular vibrating element 12 and the horn portion 25, it is preferable, for the purpose of fuel atomization, to utilize the maximum amplitude regions formed successively on the both sides of this junction point. Therefore, the junction point between the annular vibrating element 12 and the horn portion 25 is preferably selected to be displaced upward by a predetermined distance Y from the middle point between the upper and lower ends of the annular vibrating element 12, so that more maximum amplitude regions can be formed on the downstream side than the upstream side in the flowing direction of fuel.

While the above description has referred to the annular vibrating element 12, the same applies also to a disc-shaped vibrating element.

FIGS. 17 and 18 show that a disc-shaped vibrating element 12A is fixed to the free end of the horn portion 25 of the ultrasonic vibrator 11. The axial vibration of the horn portion 25 is transmitted to the disk-shaped vibrating element 12A to form a plurality of maximum amplitude regions as shown in FIG. 18.

While the disc-shaped vibrating element 12A is vibrating in such a mode, fuel is injected from the nozzle holes 13A of the nozzle of the fuel injection valve 13 in a conically diverging pattern as shown in FIGS. 19 and 20. As in the case of the annular vibrating element 12, fuel must be injected to impinge against the maximum amplitude regions of the disc-shaped vibrating element 12A.

It will be understood from the foregoing detailed description that the present invention can prevent dropping of fuel droplets from the ultrasonic vibrator and can fully atomize fuel into uniform and fine particles. Therefore, the present invention can eliminate the possibility of an undesirable abrupt increase of the CO concentration in engine exhaust gases.

We claim:

1. A fuel feeding apparatus comprising:

(a) an intake passage feeding air to an internal combustion engine;

(b) fuel feeding means disposed midway of said intake passage;

(c) vibrating means disposed in said intake passage at a position of impingement of fuel fed from a fuel feeding part of said fuel feeding means;

(d) vibration generating means having said vibrating means fixed thereto and converting electrical oscillation into mechanical vibration; and (e) electrical oscillation generating means for periodically changing the frequency of said electrical oscillation at a predetermined time interval and applying the same to said vibration generating means.

2. A fuel feeding apparatus as claimed in claim 1, wherein said vibrating means is disposed downstream of the fuel feeding part of said fuel feeding means.

3. A fuel feeding apparatus as claimed in claim 2, wherein said vibrating means is an annular element having its both end openings arranged in the flowing direction of air flowing through said intake passage.

4. A fuel feeding apparatus as claimed in claim 1, wherein said electrical oscillation generating means generates the electrical oscillation continuously relative to time.

5. A fuel feeding apparatus as claimed in claim 1, wherein said electrical oscillation generating means generates the electrical oscillation intermittently relative to time.

6. A fuel feeding apparatus as claimed in claim 5, wherein said fuel feeding means is an electromagnetic fuel injection valve injecting fuel intermittently, and said electrical oscillation generating means generates the electrical oscillation intermittently during only the open time of said electromagnetic fuel injection valve.

7. A fuel feeding apparatus comprising:

(a) an intake passage feeding air to an internal combustion engine;

(b) vibrating means disposed midway of said intake passage;

(c) vibration generating means having said vibrating means fixed thereto and converting electrical oscillation into mechanical vibration;

(d) electrical oscillation generating means for periodically changing a frequency of said electrical oscillation at a predetermined time interval and applying said electrical oscillation to said vibration generating means; and (e) fuel feeding means directing fuel toward maximum amplitude regions appearing on said vibrating means during vibration of said vibrating means.

8. A fuel feeding apparatus as claimed in claim 7, wherein said vibrating means is an annular element having its both end openings arranged in the flowing direction of air flowing through said intake passage.

9. A fuel feeding apparatus as claimed in claim 8, wherein said fuel feeding means is an electromagnetic fuel injection valve, and said electromagnetic fuel injection valve has its nozzle holes disposed above the upper end of said annular vibrating element.

10. A fuel feeding apparatus as claimed in claim 8, wherein said fuel feeding means is an electromagnetic fuel injection valve, and said electromagnetic fuel injection valve has its nozzle holes disposed intermediate between the upper and lower ends of said annular vibrating element.

11. A fuel feeding apparatus as claimed in claim 7, wherein said vibrating means is a disc-shaped element.

* * * * *